US006321036B1

(12) United States Patent
Huang

(10) Patent No.: US 6,321,036 B1
(45) Date of Patent: Nov. 20, 2001

(54) ELECTRIC WATER HEATER

(75) Inventor: Chao-Lin Huang, No. 4-12, Tien-Chung Rd., Shi-Hu Chen, Changhwa Hsien (TW)

(73) Assignee: Chao-Lin Huang, Changhwa Hsien (TW)

( * ) Notice: Subject to any disclaimer, the term of this patent is extended or adjusted under 35 U.S.C. 154(b) by 0 days.

(21) Appl. No.: 09/729,616

(22) Filed: Dec. 4, 2000

(51) Int. Cl.[7] ..... F24H 1/20; H05B 3/78
(52) U.S. Cl. ..... 392/453; 392/441; 392/445
(58) Field of Search ..... 392/441, 445, 392/447, 448, 450–455

(56) References Cited

U.S. PATENT DOCUMENTS 3,962,560 * 6/1976 Braathen ..... 392/456
4,514,617 * 4/1985 Amit ..... 392/452
4,637,347 * 1/1987 Troy ..... 122/15.1

* cited by examiner

*Primary Examiner*—Teresa Walberg
*Assistant Examiner*—Thor Campbell
(74) *Attorney, Agent, or Firm*—Kolisch Hartwell Dickinson, McCormack & Heuser

(57) ABSTRACT

An electric water heater has a base, a tank mounted on the base, a partition wall mounted in the tank to divide the tank into a heating chamber and a reservoir and at least one electric heating element extending into the heating chamber. A cool-water supply pipe extends into the heating chamber to supply cool water to the tank when a user uses the hot water stored in the reservoir, This can immediately provide unlimitedly hot water at a desired high temperature to a user. In addition, the space for locating the tank can also be reduced. The convenience of using and locating the water heater can be improved.

8 Claims, 3 Drawing Sheets

ELECTRIC WATER HEATER

BACKGROUND OF THE INVENTION

1. Field of the Invention

The present invention relates to a water heater, and more particularly to an electric water heater can immediately provide hot water unlimited hot water.

2. Description of Related Art

Electric water heaters are widely used to heat water for baths, washing clothes, cooking and so on. There are two types of conventional electric water heaters. One has a tank to store heated water, and the other one only has heating elements to heat the water. The water heater with tank can keep the water at a desired high temperature and provide hot water to a user immediately. However, this type of water heater needs a large space in which to locate the tank. Making a space for the hot water tank can be a major inconvenience. In addition, it is needs a huge amount of electrical power to heat the cold water that flows into the tank when the hot water is depleted.

Although the other type of water heater does not need the space for a tank, this type of the conventional water heater cannot provide hot water immediately. A period of time is needed to heat the water. In addition, the temperature of the water heated by the conventional water heater is unstable, especially in a place where the water pressure is unstable. This makes use of this type of the conventional water heater also inconvenient.

To overcome the shortcomings, the present invention tends to provide an improved electric water heater to mitigate or obviate the aforementioned problems.

SUMMARY OF THE INVENTION

The main objective of the invention is to provide an improved electric water heater that can immediately provide unlimited hot water. The water heater has a base, a tank mounted on the base, a partition wall mounted in the tank and at least one electric heating element. The partition wall divides the tank into a heating chamber and a reservoir. At least one heating element extends into the heating chamber. A cool-water supply pipe extends into the heating chamber to supply cool water to the tank when a user uses the hot water stored in the reservoir. This can immediately provide unlimitedly hot water at a desired high temperature to a user. In addition, the space for locating the tank can be reduced.

Other objects, advantages and novel features of the invention will become more apparent from the following detailed description when taken in conjunction with the accompanying drawings.

DETAILED DESCRIPTION OF PREFERRED EMBODIMENT

Figure 1:
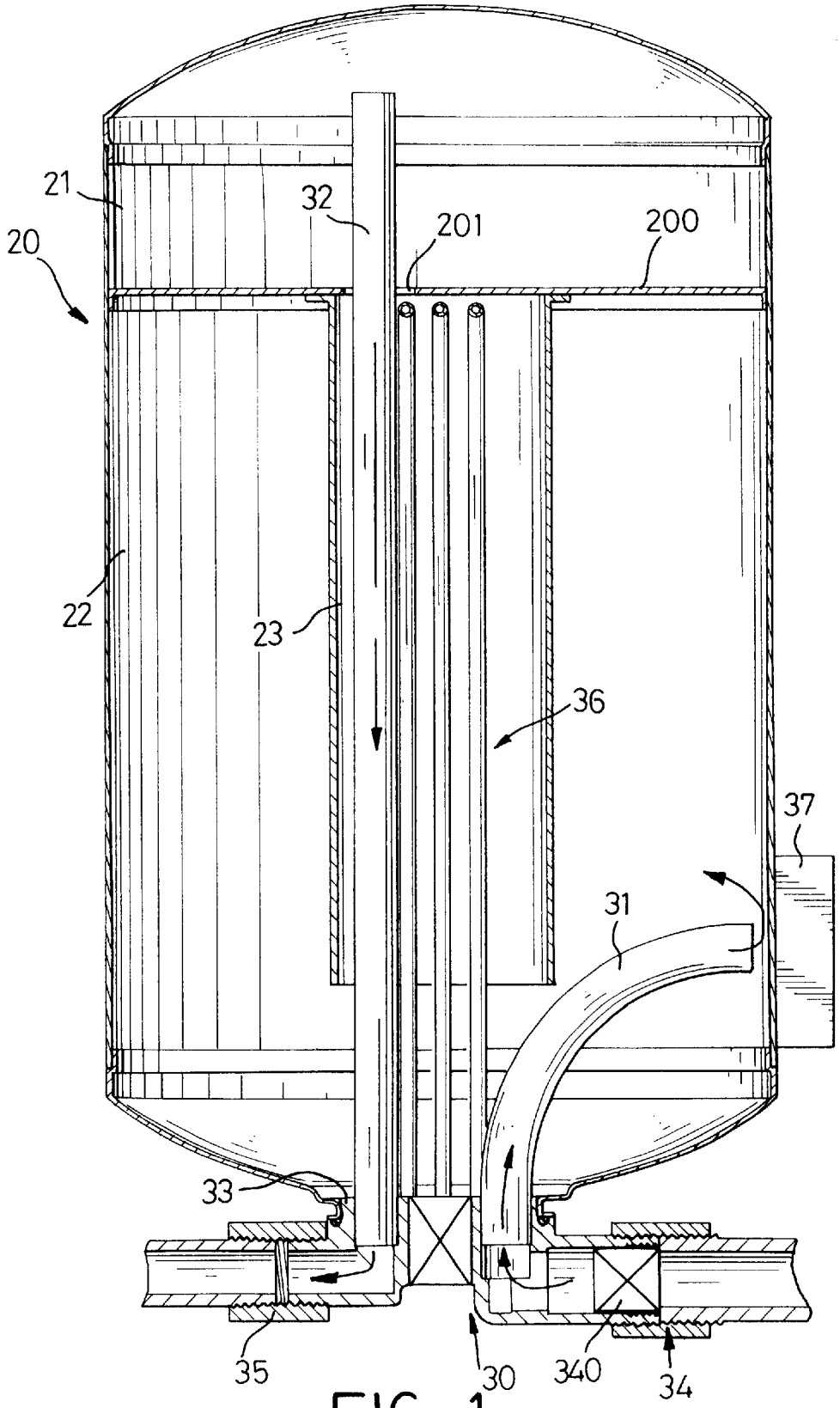
FIG. 1 is a side plan view in partial section of an electric water heater in accordance with the present invention.
Figure 2:
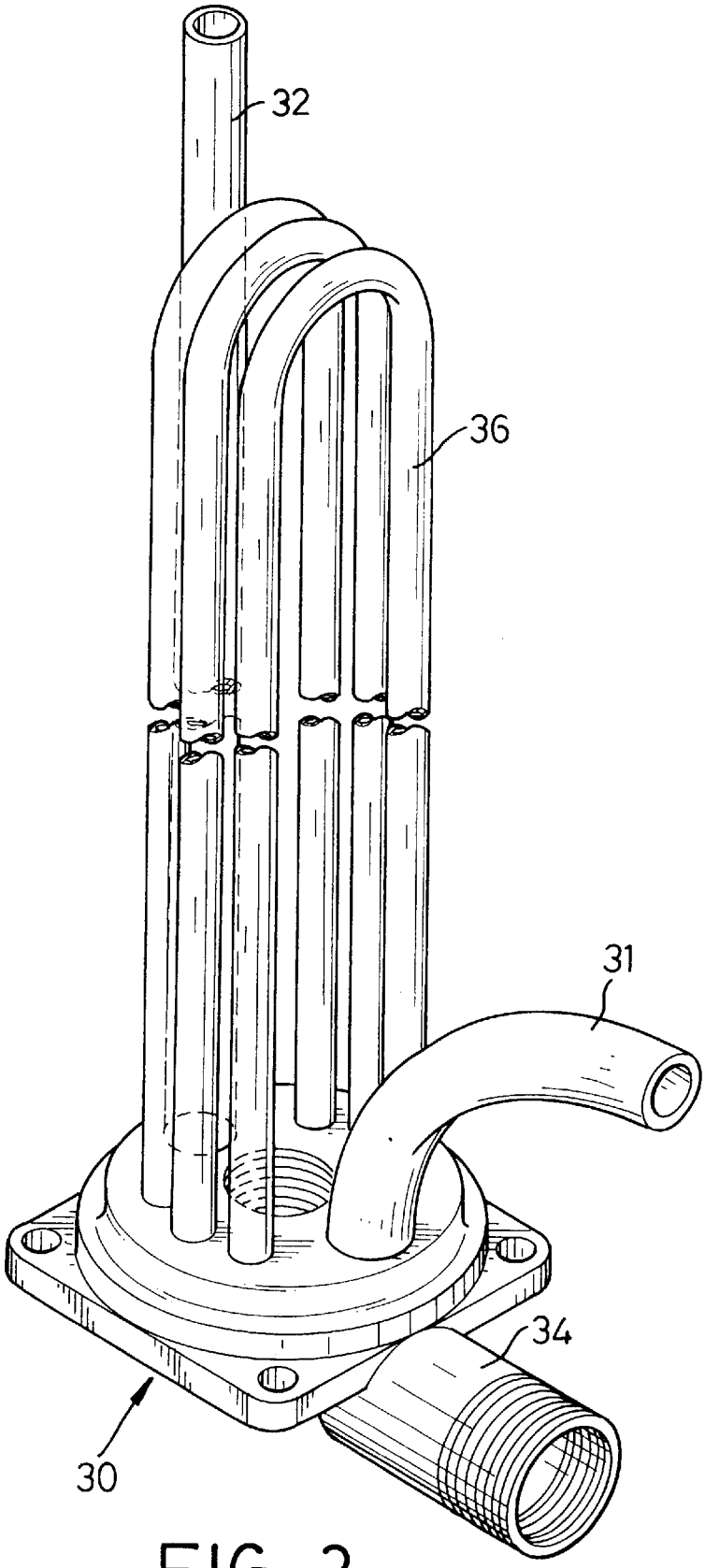
FIG. 2 is a perspective view of the base of the electric water heater in FIG. 1 with the heating elements.

With reference to FIGS. 1 and 2, an electric water heater in accordance with the present invention comprises a base (30), a tank (20) and at least one heating element (36). The tank (20) is secured to the base (30). A protrusion (33) is formed on the top of the base (30). An opening is defined in the bottom of the tank (20) to engage with the protrusion (33) on the base (30).

A lateral partition wall (200) is mounted in the tank (20) to divide the tank (20) into a heating chamber (22) below the partition wall (200) and a reservoir (21) above the heating chamber (22). A tube (23) is mounted on tile bottom of the partition wall (200) and extends into the heating chamber (22). An opening is defined in the lowermost end of the tube (23) to communicate with the heating chamber (22). A through hole (201) is defined in the partition wall (200) so the reservoir (21) communicates with the heating chamber (22). In practice, the through hole (201) communicates with the tube (23).

A hot-water discharge pipe (32) extends into the tank (20) and communicates with the reservoir (21). The discharge pipe (32) can be connected to a tap to provide hot water to a user. A cool-water supply pipe (31) extends into the tank (20) and communicates with the heating chamber (21). The discharge pipe (32) and the supply pipe (31) are mounted on the base (30). An outlet (35) and an inlet (34) are defined in the base (30) to respectively communicate with the discharge pipe (32) and the supply pipe (31). The discharge pipe (32) extends through the heating chamber (21), tube (23) and through hole (201) and into the reservoir (21). By such arrangement, the hot water in the reservoir (21) can be sent to the tap through the discharge pipe (32) and the outlet (35) in the base (30). The cool water can be supplied to the heating chamber (22) through the inlet (34) and the supply pipe (31). This resupplies water to the tank (20) as the hot water in the reservoir (21) is depleted. A check valve (340) is mounted in the inlet (34) to keep the water in the tank (20) from flowing through the inlet (34) into the water supply.

Figure 3:
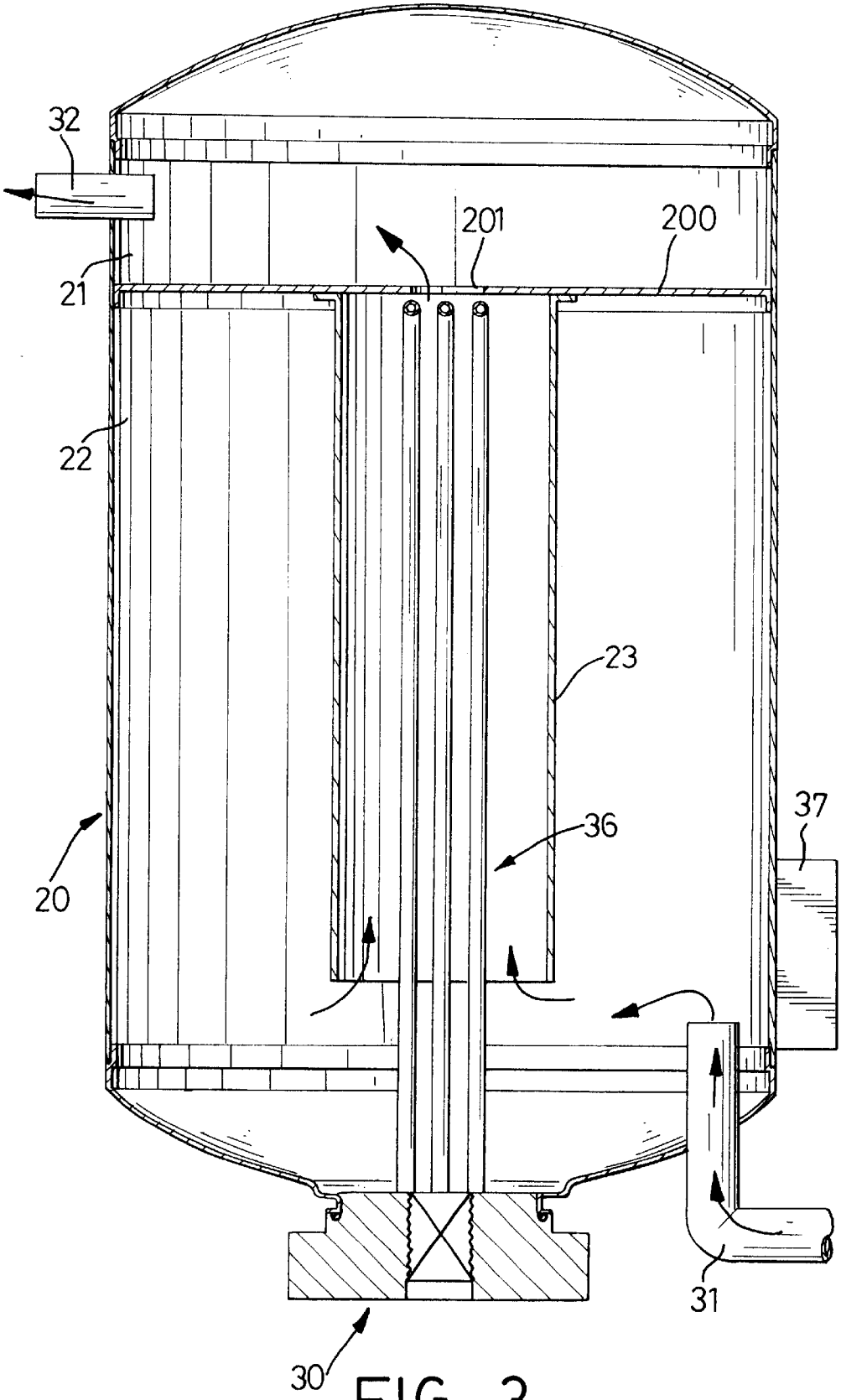
FIG. 3 is a side plan view in partial section of another embodiment of an electric water heater in accordance with the present invention.

With reference to FIG. 3, the discharge pipe (32) and the supply pipe (31) are directly mounted on the tank (20) in another embodiment of the water heater in accordance with the invention.

Each heating element (36) is mounted on the base (30) and extends into the heating chamber (22) and the tube (23). A sensor (37) is mounted on the tank (20) and extends into the heating chamber (22) to detect the temperature in the heating chamber (22). The sensor (37) faces the opening in the supply pipe (31).

With reference to FIGS. 1–3, when the tap connected to the outlet (35) of the base (30) or the discharge pipe (32) is opened, hot water stored in the reservoir (21) will flow through the discharge pipe (32) and the outlet (35) in the base (30) to the tap. Cool water will simultaneously be added to the heating chamber (22) through the inlet (34) in the base (30) and the supply pipe (31). When, the water is added to the heating chamber (21), the sensor (37) will detect that the temperature of the water falls. The heating elements (36) will be activated to heat the water in the heating chamber (21). The heated water flows into the reservoir (22) replace the water used. In practice, the opening of the supply pipe (31) is located above the opening of the tube (23). Accordingly, the cool water will not flow into the tube (23) and through the through bole (201) directly. The cool water can be actually heated by the heating elements (36). Therefore, the water heater can provide unlimited hot water with a constant high temperature to the user. In addition, because the cool water is added and heated immediately, unlimited hot water can still be provide to the user even though there is no huge tank (20). The space for the water heater to be located can be reduced. The use of the water heater in accordance with the present invention is more convenient than that of the conventional one. Furthermore, before the cool water is heated, the cool water will mix with the hot water. Therefore, the electrical power for heating the cool water to a desired temperature can be reduced.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A water heater comprising:

a base;

a tank mounted on the base;

a partition wall mounted in the tank to divide the tank into a heating chamber below the partition wall and a reservoir above the partition wall;

a tube extending from a bottom side of the partition wall and having an opening defined in a bottom end of the tube;

a through hole defined in the partition wall for communicating with the tube;

at least one electric heating element mounted on the base and extending into the tube;

a hot-water discharge pipe extending into the tank and communicating with the reservoir; and a cool-water supply pipe extending into the tank and having an opening communicating with the heating chamber.

2. The water heater as claimed in claim 1, wherein the hot-water discharge pipe is mounted on the base and extends through the heating chamber, the tube and the through hole to communicate with the reservoir; and the base has an outlet defined to communicate with the hot-water discharge pipe.

3. The water heater as claimed in claim 1, wherein the hot-water discharge pipe is attached to the tank.

4. The water heater as claimed in claim 1, wherein the cool-water supply pipe is attached to the base and extends into the heating chamber; and an inlet is defined in the base and communicates with the cool-water supply pipe.

5. The water heater as claimed in claim 4, wherein a check valve is mounted in the inlet of the base.

6. The water heater as claimed in claim 1, wherein the cool-water supply pipe is attached to the tank.

7. The water heater as claimed in claim 1, wherein a sensor is mounted in the tank and faces the opening of the cool-water supply pipe to detect the temperature of the water in the heating chamber.

8. The water heater as claimed in claim 1, wherein the opening of the supply pipe is located above the opening of the tube.

* * * * *